United States Patent [19]

Kato et al.

[11] Patent Number: 4,880,716

[45] Date of Patent: Nov. 14, 1989

[54] ELECTROPHOTOGRAPHIC LITHOGRAPHIC PRINTING PLATE PRECURSOR HAVING RESIN OUTER LAYER

[75] Inventors: Eiichi Kato; Kazuo Ishii, both of Shizuoka, Japan

[73] Assignee: Fuji Photo Film Co., Ltd., Kanagawa, Japan

[21] Appl. No.: 154,547

[22] Filed: Feb. 10, 1988

[30] Foreign Application Priority Data

Feb. 12, 1987 [JP] Japan ..... 62-28345
Sep. 11, 1987 [JP] Japan ..... 62-226694

[51] Int. Cl.[4] ..... G03G 5/14; G03G 13/26

[52] U.S. Cl. ..... 430/49; 430/66; 430/273; 430/537

[58] Field of Search ..... 430/49, 66, 67, 273, 430/537

[56] References Cited

U.S. PATENT DOCUMENTS 4,792,511 12/1988 Kato et al. ..... 430/87

*Primary Examiner*—J. David Welsh
*Attorney, Agent, or Firm*—Sughrue, Mion, Zinn, Macpeak & Seas

[57] ABSTRACT

An electrophotographic lithographic printing plate precursor comprising a conductive support having provided thereon at least one photoconductive layer and further provided thereon an outermost surface layer is disclosed, in which said surface layer contains at least one resin having at least one functional group capable of forming a carboxyl group upon decomposition which is represented by formula (I):

$$-\underset{\underset{O}{\|}}{C}-X \qquad (I)$$

wherein x is as defined in the specification. The surface layer can be rendered highly hydrophilic while exhibiting water resistance when subjected to oil-desensitization processing after toner image formation to provide a lithographic printing plate having excellent printing durability.

16 Claims, No Drawings

ELECTROPHOTOGRAPHIC LITHOGRAPHIC PRINTING PLATE PRECURSOR HAVING RESIN OUTER LAYER

FIELD OF THE INVENTION

This invention relates to an electrophotographic lithographic printing plate precursor and, more particularly to a lithographic printing plate precursor having a photoconductive layer on which a surface layer having specific properties is provided.

BACKGROUND OF THE INVENTION

A number of offset printing plate precursors for directly producing printing plates have hitherto been proposed, and some of them have already been put into practical use. Widely employed among them is a system in which a photoreceptor, comprising a conductive support having provided thereon a photoconductive layer mainly comprising photoconductive particles (e.g., zinc oxide) and a resin binder, is subjected to an ordinary electrophotographic processing to form a highly lipophilic toner image thereon. The surface of the photoreceptor is then treated with an oil-desensitizing solution called etching solution to selectively render non-image areas hydrophilic to obtain an offset printing plate.

Requirements of offset printing plate precursors for obtaining satisfactory prints are such that an original should be reproduced faithfully on the photoreceptor; the surface of a photoreceptor should have affinity with an oil-desensitizing solution, so as to render non-image areas sufficiently hydrophilic and, at the same time, should have water resistance; and that a photoconductive layer having an image formed thereon is not released during printing and is well receptive to dampening water, so that the non-image areas hold the hydrophilic properties enough to be freed from stains even on printing a large number of prints.

For particular use as an offset printing plate precursor, formation of background stains due to insufficient oil-densensistivity presents a serious problem. In order to solve this problem, various resins as binders for zinc oxide have been proposed. For example, such resins have been disclosed in Japanese Patent Publication No. 31011/75, Japanese patent application (OPI) Nos. 54027/78, 20735/79, 202544/82, and 68046/83 (the term "OPI" as used herein refers to a "published unexamined Japanese patent application"). Nevertheless, actual evaluations of these resins proposed for improving oil-desensitivity have revealed that none were satisfactory in terms of stain resistance and printing durability.

On the other hand, a photoconductive layer comprising particles of an organic photoconductive compound and a binder resin can be formed on a grained aluminum base. Printing plate precursors of this type can be produced by forming a toner image on a photosensitive layer through the known electrophotographic processing such as described above and further removing the non-image areas by eluting with a processing solution, whereby the aluminum base corresponding to the non-image areas is exposed to form hydrophilic areas. The photosensitive layer using the organic photoconductive compound comprises, for example, an oxadiazole compound or oxazole compound and an alkali-soluble binder resin (e.g., a styrene-maleic anhydride copolymer, etc.), as disclosed in Japanese Patent Publication Nos. 17162/62 and 39405/71 and Japanese patent application (OPI) Nos. 2437/77 and 107246/81; or a phthalocyanine pigment or azo pigment and an alkali-soluble phenolic resin as disclosed in Japanese patent application (OPI) Nos. 105254/80, 16125/70, 150953/83, and 162961/83.

However, since the above-mentioned plate making process involves removal of the photosensitive layer corresponding to the non-image areas by dissolution, it requires a large-size apparatus and is too time-consuming to achieve a reasonable production rate. Also, the use of an organic solvent as the processing solution (such as ethylene glycol, glycerin, methanol, ethanol, etc.), involves problems of cost, safety, environmental pollution, working hygiene, and the like.

It has been proposed to provide a specific resin layer capable of being rendered hydrophilic on a usual electrophotographic photoreceptor as described in Japanese Patent Publication No. 5606/70. According to this system, a surface layer comprising a vinyl ether-maleic anhydride copolymer and a hydrophobic resin compatible with the copolymer is provided on the photosensitive layer. After toner image formation, the non-image areas of the surface layer can be rendered hydrophilic by treating with an alkali to hydrolytically opening the acid anhydride ring.

However, since the vinyl ether-maleic anhydride copolymer used in the surface layer becomes water-soluble upon ring-opening, the surface layer is seriously inferior in water resistance even though the vinyl ether-maleic anhydride copolymer is combined with a compatible hydrophobic resin. Therefore, the printing durability of the resulting printing plate was about 500 to 600 prints at most.

It has also been proposed to form a surface layer capable of being rendered hydrophilic, which comprises silylated polyvinyl alcohol as main component and a crosslinking agent as disclosed in Japanese patent application (OPI) No. 217292/86. According to this proposal, after toner image formation, the surface layer can be rendered hydrophilic by hydrolysis of the silylated polyvinyl alcohol on the non-image areas. Further, in order to retain fine strength after becoming hydrophilic, the degree of silylation of polyvinyl alcohol is controlled, and the remaining hydroxyl group is crosslinked by the crosslinking agent.

The above publication describes that the provision of such a surface layer would prevent background stains of prints and increase printing durability. However, it has been shown by evaluation of actual use that the resulting printing plate still does not satisfy the stain resistance requirement. Further, due to the nature of the high-molecular reaction, it is difficult to stably produce the silylated polyvinyl alcohol having a controlled degree of silylation by silylating polyvinyl alcohol with a silylating agent to a desired degree. In addition, due to the limitations on the chemical structure of the hydrophilic polymer, it is difficult to exclude all adverse influences of the surface layer upon the functions of an electrophotographic photoreceptor, such as charging properties, quality of a reproduced image (e.g., dot reproducibility and resolving power of image areas, resistance to background fog of nonimage areas, etc.), and light sensitivity.

SUMMARY OF THE INVENTION

One object of this invention is to provide a lithographic printing plate precursor which reproduces an image faithful to an original, forms neither background stains evenly over the entire surface nor dot-like stains, and exhibits excellent oil-desensitivity.

Another object of this invention is to provide a lithographic printing plate which retains sufficient hydrophilic properties on its non-image areas so as to exhibit stain resistance and high printing durability even when used for printing a large number of prints.

A further object of this invention is to provide a lithographic printing plate precursor having a surface layer rendered hydrophilic on non-image areas, the surface layer comprising a resin which can be synthesized easily.

It has now been found that the above objects can be accomplished by an electrophotographic lithographic printing plate precursor comprising a conductive support, having provided thereon at least one photoconductive layer and further provided thereon an outermost surface layer, in which said surface layer contains at least one resin having at least one functional group capable of forming a carboxyl group upon decomposition.

DETAILED DESCRIPTION OF THE INVENTION

The resin which can be used in the present invention contains at least one functional group capable of forming one or more carboxyl groups upon being decomposed, the functional group being represented by formula (I).

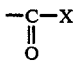

(I)

wherein X represents

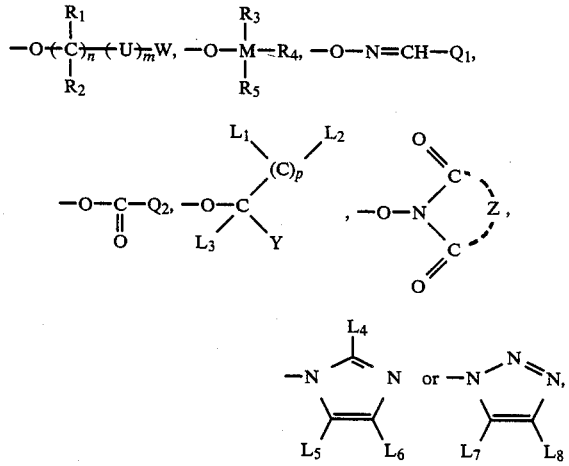

wherein $R_1$ and $R_2$, which may be the same or different, each represents a hydrogen atom or an aliphatic group; U represents an aromatic ring; W represents a hydrogen atom, a halogen atom, a trihalomethyl group, an alkyl group, —CN, —$NO_2$, —$SO_2R_6$m—$COOR_7$ or —O—$R_8$, wherein $R_6$, $R_7$, and $R_8$ each represents a hydrocarbon group; n and m each represents 0, 1 or 2; $R_3$, $R_4$, and $R_5$, which may be the same or different, each represents a hydrocarbon group or —O—$R_9$, wherein $R_9$ represents a hydrocarbon group; M represents Si, Sn or Ti; $Q_1$ and $Q_2$ each represents a hydrocarbon group; Y represents an oxygen atom or a sulfur atom; $L_1$, $L_2$, and $L_3$, which may be the same or different, each represents a hydrogen atom or an aliphatic group; p represents 3 or 4; Z represents an organic residue forming a cyclic imide group; and $L_4$, $L_5$, $L_6$, $L_7$, and $L_8$, which may be the same or different, each represents a hydrogen atom or an aliphatic group; or $L_5$ and $L_6$, or $L_7$ and $L_8$ are connected to each other, respectively, to form a condensed ring.

In formula (I) where X represents

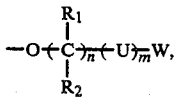

$R_1$ and $R_2$, which may be the same or different, preferably represents a hydrogen atom or a substituted or unsubstituted straight or branched chain alkyl group having from 1 to 6 carbon atoms (e.g., methyl, ethyl, propyl, chloromethyl, dichloromethyl, trichloromethyl, trifluoromethyl, butyl, hexyl, hydroxyethyl and 3-chloropropyl groups). U preferably represents a substituted or unsubstituted phenyl or naphthyl group (e.g., phenyl, methylphenyl, chlorophenyl, dismethylphenyl, chloromethylphenyl and naphthyl groups). W preferably represents a hydrogen atom, a halogen atom (e.g., chlorine and fluorine atoms), a trihalomethyl group (e.g., trichloromethyl and trifluoromethyl groups), a substituted or unsubstituted straight or branched chain alkyl group having from 1 to 6 carbon atoms (e.g., methyl, chloromethyl, dichloromethyl, ethyl, propyl, butyl, hexyl, tetrafluoroethyl, cyanoethyl, and chloroethyl groups), —CN, —$NO_2$, —$SO_2R_6$ (wherein $R_6$ represents an aliphatic group, such as a substituted or unsubstituted alkyl group having from 1 to 12 carbon atoms, e.g., methyl, ethyl, propyl, butyl, chloroethyl, pentyl and octyl groups, and a substituted or unsubstituted aralkyl group having from 7 to 12 carbon atoms, e.g., benzyl, phenethyl, chlorobenzyl, methoxybenzyl, chlorophenethyl and methylphenethyl groups, or an aromatic group, such as a substituted or unsubstituted phenyl group and a naphthyl group, e.g., phenyl, chlorophenyl, dichlorophenyl, methylphenyl, methoxyphenyl, acetylphenyl, acetamidophenyl, methoxycarbonyphenyl and naphthyl group), —$COOR_7$ (wherein $R_7$ has the same meaning as $R_6$) or —O—$R_8$ (wherein $R_8$ has the same meaning as $R_6$). n and m each represents 0, 1 or 2.

Specific examples of the group as represented by

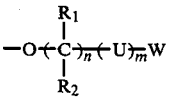

include a β,β,β-trichloroethyl group, a β,β,β-trifluoroethyl group, a hexafluoroisopropyl group, a group of formula —$CH_2(CF_2CF_2)_{n'}$ (wherein n' represents an integer of from 1 to 5), a 2-cyanoethyl group, a 2-cyanoethyl group, a 2-nitroethyl group, a 2-methanesulfonylethyl group, a 2-ethanesulfonylethyl group, a 2-butanesulfonylethyl group, a benzenesulfonylethyl group, a 4-nitrobenzenesulfonylethyl group, a 4-cyanobenzenesulfonylethyl group, a 4-methylbenzenesulfonylethyl group, a benzyl group, a substituted benzyl group (e.g., methoxybenzyl, trimethylbenzyl, pentamethylbenzyl and nitrobenzyl groups), a phenacyl group, a substituted phenacyl group (e.g., bromophenacyl group), a phenyl group, a substituted phenyl group (e.g., nitrophenyl, cyanophenyl, methanesulfonylphenyl, trifluoromethylphenyl and dinitrophenyl groups), etc.

In formula (I) where X represents

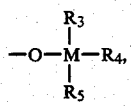

$R_3$, $R_4$, and $R_5$, which may be the same or different, each preferably represents a substituted or unsubstituted aliphatic group having from 1 to 6 carbon atoms, including an alkyl group, an alkenyl group, an aralkyl group, and an alicyclic group each of which may be substituted with a halogen atom, —CN, —OH, —O—Q', etc., wherein Q' represents an alkyl group, an aralkyl group, an alicyclic group or an aryl group) and a substituted or unsubstituted aromatic group having from 6 to 14 carbon atoms (e.g., phenyl, tolyl, chlorophenyl, methoxyphenyl, acetamidophenyl, and naphthyl groups), or —O—$R_9$, wherein $R_9$ represents a substituted or unsubstituted alkyl group having from 1 to 6 carbon atoms, a substituted or unsubstituted alkenyl group having from 2 to 6 carbon atoms, a substituted or unsubstituted aralkyl group having from 7 to 12 carbon atoms, a substituted or unsubstituted alicyclic group having from 5 to 10 carbon atoms or a substituted or unsubstituted aryl group having from 6 to 10 carbon atoms. M represents Si, Ti or Sn, preferably Si. *In formula (I) where X represents —O—N=CH—$Q_1$* or

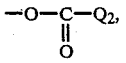

$Q_1$ and $Q_2$ each preferably represents a substituted or unsubstituted aliphatic group having from 1 to 6 carbon atoms, including alkyl, alkenyl, aralkyl, and alicyclic groups each of which may be substituted with a halogen atom, —CN, an alkoxy group, etc., or a substituted or unsubstituted aryl group having from 6 to 12 carbon atoms (e.g., phenyl, methoxyphenyl, tolyl, chlorophenyl and naphthyl groups).

Of the above-described groups representing X of formula (I), the preferred are those represented by

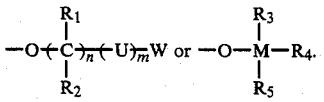

In formula (I) where X represents

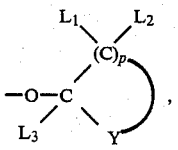

Y represents an oxygen atom or a sulfur atom. $L_1$, $L_2$, and $L_3$, which may be the same or different, each preferably represents a hydrogen atom, a substituted or unsubstituted straight or branched chain alkyl group having from 1 to 18 carbon atoms (e.g., methyl, ethyl, propyl, butyl, hexyl, octyl, decyl, dodecyl, octadecyl, chloroethyl, methoxyethyl, and methoxypropyl groups), a substituted or unsubstituted alicyclic groups (e.g., cyclopentyl and cyclohexyl groups), a substituted or unsubstituted aralkyl group having from 7 to 12 carbon atoms (e.g., benzyl, phenethyl, chlorobenzyl and methoxybenzyl groups), a substituted or unsubstituted aromatic group (e.g., phenyl, naphthyl, chlorophenyl, tolyl, methoxyphenyl, methoxycarbonylphenyl and dichlorophenyl groups), or —O—L', wherein L' represents a hydrocarbon group, and specifically the same groups as set forth above for $L_1$, $L_2$, and $L_3$. p represents an integer 3 or 4.

In formula (I) where X represents

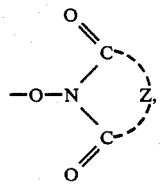

represents an organic residue forming a cyclic imide group, and preferably an organic residue represented by formula (II) or (III):

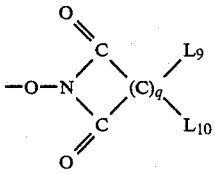

(II)

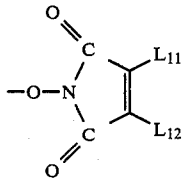

(III)

wherein $L_9$ and $L_{10}$, which may be the same or different, each represents a hydrogen atom, a halogen atom (e.g., chlorine and bromine atoms), a substituted or unsubstituted alkyl group having from 1 to 18 carbon atoms (e.g., methyl, ethyl, propyl, butyl, hexyl, octyl, decyl, dodecyl, hexadecyl, octadecyl, 2-chloroethyl, 2-methoxyethyl, 2-cyanoethyl, 3-chloropropyl, 2-(methanesulfonyl)ethyl and 2-(ethoxyoxy)ethyl groups), a substituted or unsubstituted aralkyl group having from 7 to 12 carbon atoms (e.g., benzyl, phenethyl, 3-phenylpropyl, methylbenzyl, dimethylbenzyl, methoxybenzyl, chlorobenzyl and bromobenzyl groups), a substituted or unsubstituted alkenyl group having from 3 to 18 carbon atoms (e.g., allyl, 3-methyl-2-propenyl, 2-hexenyl, 4-propyl-2-pentenyl and 12-octadecenyl groups), —$SL_{13}$ (wherein $L_{13}$ represents a group selected from the alkyl, aralkyl and alkenyl groups for $L_9$ or $L_{10}$, a substituted or unsubstituted aryl group (e.g., phenyl, tolyl, chlorophenyl, bromophenyl, methoxyphenyl, ethoxyphenyl and ethoxycarbonylphenyl groups)), or $NHL_{14}$ (wherein $L_{14}$ has the same meaning as $L_{13}$); or $L_9$ and $L_{10}$ together may form a ring, e.g., a 5- to 6-membered monocyclic ring (e.g., a cyclopentyl ring, a cyclohexyl ring, etc.) and a 5- to 6-membered bicyclic ring (e.g., bicycloheptane, bicycloheptane, bicyclooctane, and bicyclooctene rings), each of which may have a substituent selected from the groups for $L_9$ or $L_{10}$. q represents 2 or 3. $L_{11}$ and $L_{12}$, which may be the same or different, each has the same meaning as $L_9$ or $L_{10}$, or $L_{11}$ and $L_{12}$ together may form an aromatic ring (e.g., benzene and naphthalene rings).

In formula (I) where X represents

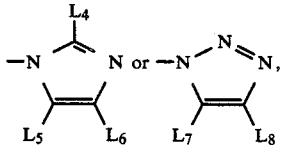

$L_4$, $L_5$, $L_6$, $L_7$, and $L_8$ each preferably represents a hydrogen atom or an aliphtic group preferably selected from the groups for $L_1$, $L_2$ or $L_3$, or a pair of $L_5$ and $L_6$ or a pair of $L_7$ and $L_8$ are connected to each other to form a condensed ring, and preferably a 5- to 6-membered monocyclic ring (e.g., cyclopentyl and cyclohexyl rings) or a 5- to 12-membered aromatic ring (e.g., benzene, naphthalene, thiophene, pyrrole, pyrane and quinoline rings).

The resin containing at least one of the functional groups represented by formula (I) can be prepared by Process (A) comprising converting a carboxyl group or a carboxylic acid halide group of a polymer into the functional group of formula (I) through a high-molecular reaction, or Process (B) comprising polymerizing at least one monomer containing at least one functional group of formula (I) or copolymerizing such a monomer with other copolymerizable monomers.

Conversion of a carboxyl group of a polymer to the functional group of formula (I) by high-molecular reaction can be carried out according to the same process as for synthesizing a monomer containing such a functional group. The method for converting a carboxyl group of a monomer to the functional group of formula (I) is described in detail, e.g., in Nihon Kagakukai (ed.), *Shinjikken Kagaku Koza,* Vol. 14, "Yuki Kagobutsu no Gosei to Han-no (V)", p.. 2535, Maruzen K. K. and J. F. W. Hc Cmie, *Protective Groups in Organic Chemistry.*

Process (B) is preferred to Process (A), because the former process can arbitrarily control the functional group (I) and allows no incorporation of impurities. In some detail, according to Process (B), a carboxyl group of a carboxylic acid compound containing a polymerizable double bond is converted to any of the functional groups of formula (I), for example, by the above-described known process, and the resulting functional group-containing compound is polymerized.

The monomer compound containing the functional group of formula (I) which can be used in Process (B) specifically include those represented by formula (IV) as set forth below:

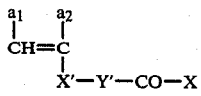

(IV)

wherein X is as defined above; X′ represents

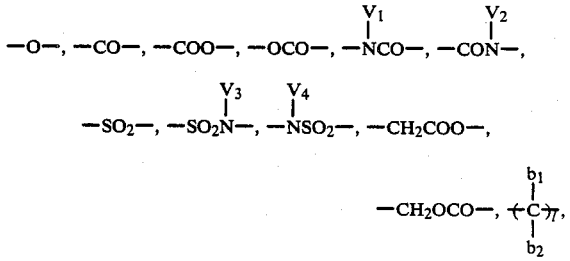

an aromatic group, or a heterocyclic group, wherein $V_1$, $V_2$, $V_3$, and $V_4$ each represents a hydrogen atom, a hydrocarbon residue, or the group —Y′—CO—X in formula (IV); $b_1$ and $b_2$, which may be the same or different, each represents a hydrogen atom, a hydrocarbon group, or the group —Y′—CO—X in formula (IV); and l represents 0 or an integer of from 1 to 18; Y′ represents a carbon-carbon bond for linking X′ and —CO—X which may contain a hetero atom (e.g., an oxygen atom, a sulfur atom, or a nitrogen atom); and $a_1$ and $a_2$, which may be the same or different; each represents a hydrogen atom, a hydrocarbon group (e.g., an alkyl group having from 1 to 12 carbon atoms, which may be substituted with a carboxyl group, etc.), a carboxyl group, or —COO—T, wherein T represents an alkyl, alkenyl, aralkyl, alicyclic, or aromatic group having from 1 to 18 carbon atoms which may be substituted with a group containing —CO—X.

In formula (IV), the linking group as represented by Y′ is composed of a divalent group, such as

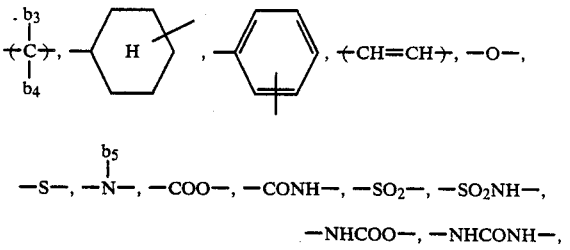

etc., or a combination thereof, wherein $b_3$, $b_4$, and $b_5$ each has the same meaning as $b_1$ or $b_2$.

Specific but non-limiting examples of the monomer compounds containing the functional group of formula (I) are shown below.

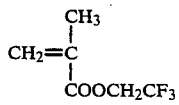

(1)

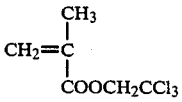

(2)

-continued
(3)
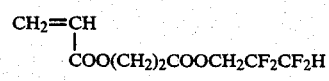
(4)
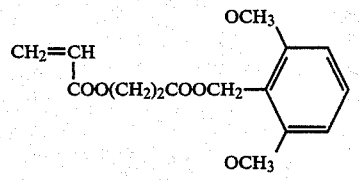
(5)
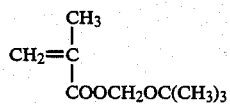
(6)
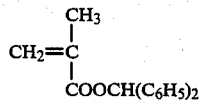
(7)
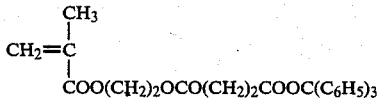
(8)
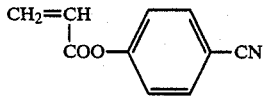
(9)
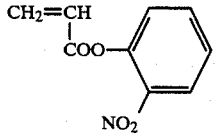
(10)
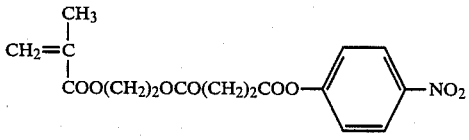
(11)
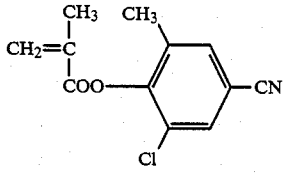
(12)
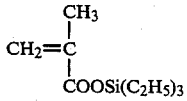
(13)
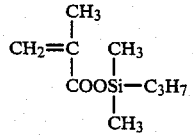
(14)
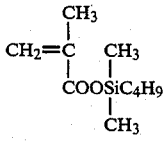

-continued
(15)
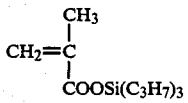
(16)
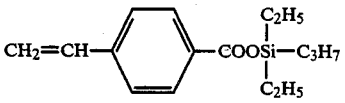
(17)
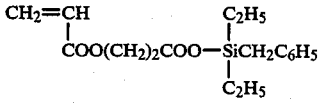
(18)
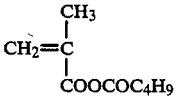
(19)
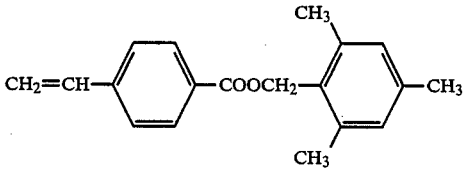
(20)
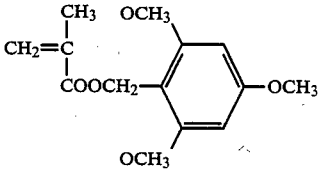
(21)
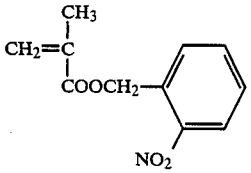
(22)
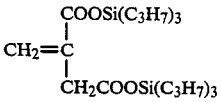
(23)
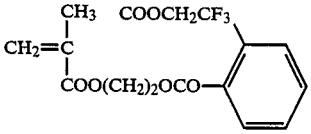
(24)
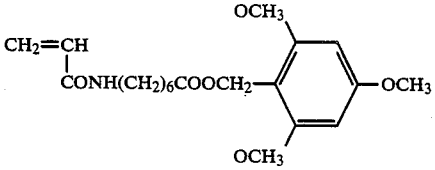
(25)
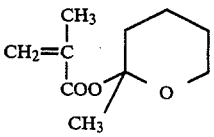

-continued
(26)
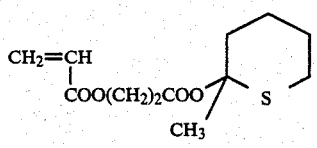
(27)
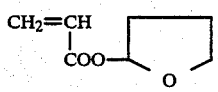
(28)
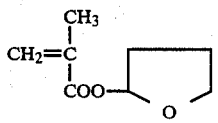
(29)
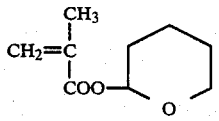
(30)
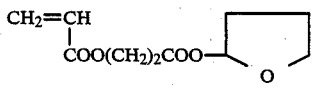
(31)
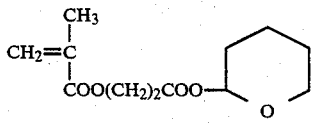
(32)
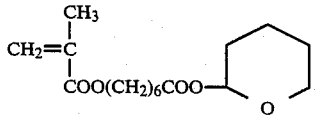
(33)
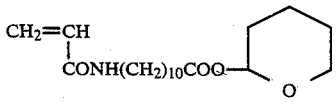
(34)
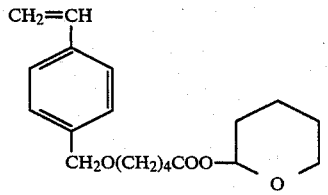
(35)
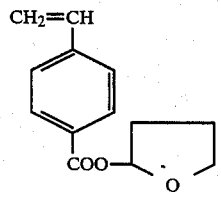
(36)
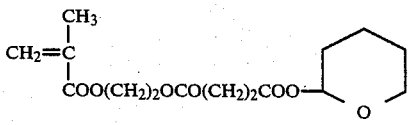

-continued
(37)
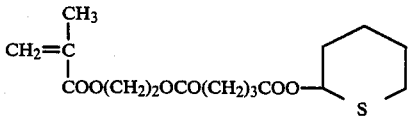
(38)
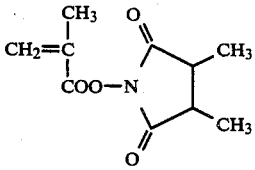
(39)
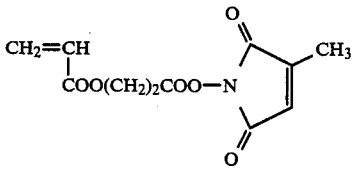
(40)
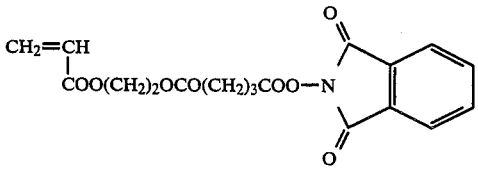
(41)
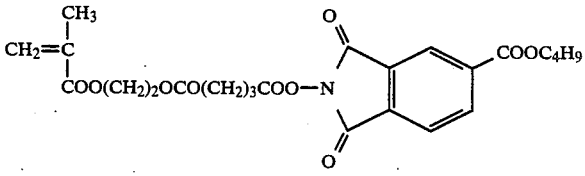
(42)
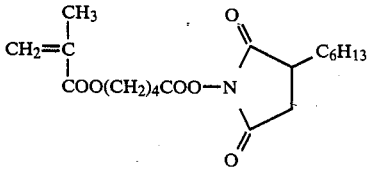
(43)
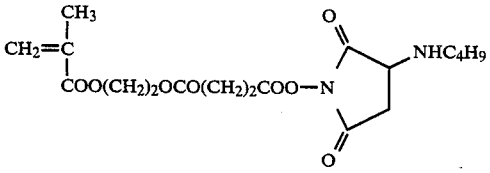
(44)
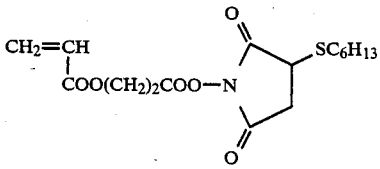
(45)
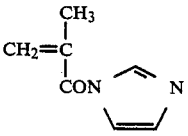
(46)
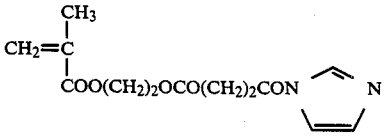

-continued
(47)
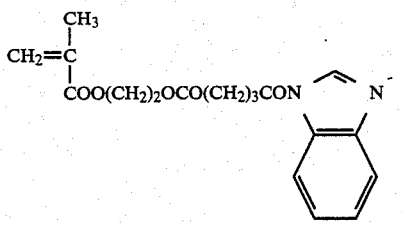
(48)
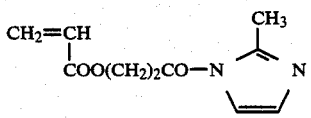
(49)
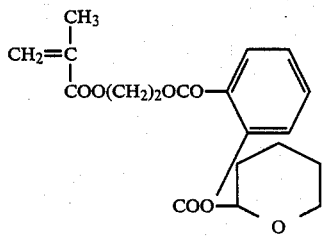
(50)
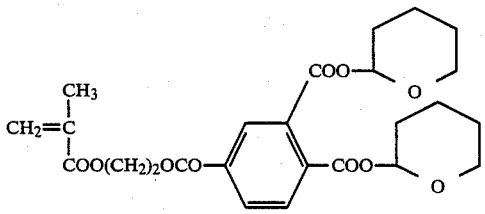
(51)
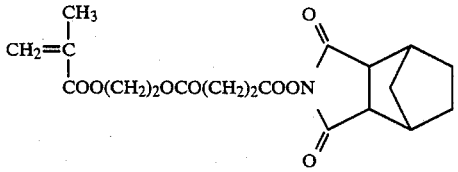
(52)
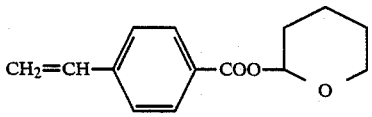
(53)
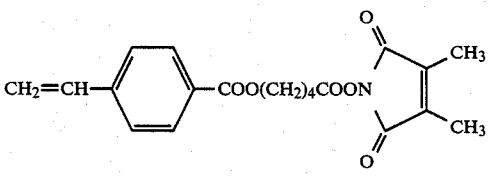
(54)
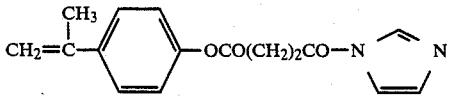
(55)
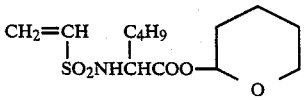
As previously described, these monomers may be either homopolymerized or copolymerized with other copolymerizable monomers. Examples of the comonomers to be used include vinyl or allyl esters of aliphatic carboxylic acids (e.g., vinyl acetate, vinyl propionate, vinyl butyrate, allyl acetate, allyl propionate, etc.); unsaturated carboxylic acids (e.g., acrylic acid, methacrylic acid, crotonic acid, itaconic acid, maleic acid, fumaric acid, etc., and esters or amides thereof); styrene derivatives (e.g., styrene, vinyltoluene, α-methylstyrene, etc.); α-olefins; acrylonitrile; methacrylonitrile; vinyl-substituted heterocyclic compounds (e.g., N-vinylpyrrolidone, etc.); and the like.

In order to enhance the film strength of the surface layer, a crosslinking reaction can be taken advantage of as hereinafter described. In this regard, it is preferable to copolymerize a monomer containing a functional group which easily undergoes crosslinking, such as epoxy, amino, isocyanate, carboxyl and hydroxyl groups. Details for such copolymerization are described in reference cited in Nihon Kagakukai (ed.), *Shinjikken Kagaku Koza,* vol. 14, "Yuki Kagobutsu no Gose to Han-no (V)", 2505, Maruzen K. K., and Yoshio Kwakura and Keisuke Kurita, *Han-nosei Kobunshi,* 170, Kodansha.

The resin containing the functional group of formula (I) is a homo- or copolymer comprising from 40 to 100% by weight of a monomer unit containing the functional group, and preferably a cpolymer comprising from 40 to 80% by weight of such a monomer unit. The resin according to the present invention has a molecular weight of from $1\times10^3$ to $1\times10^6$, and preferably from $5\times10^3$ to $5\times10^5$.

In the present invention, conventionally known resins may also be used in combination with the above-described resins according to the present invention. Such resins include silicone resins, alkyd resins, vinyl acetate resins, polyester resins, styrene-butadiene resins, acrylic resins, and the like. Specific examples of these known resins are described, e.g., in T. Kurita et al., *Kobunshi,* Vol. 17, 278 (1968), H, Miyamoto et al., *Imaging,* No. 8, 9 (1973), etc.

The mixing ratio of the resin according to the present invention and the known resin is arbitrary, as long as the proportion of a component containing the functional group of formula (I) falls within the range of from 40 to 100% by weight, and preferably from 40 to 80% by weight, based on the total resin present in the surface layer. If the proportion of the functional group-containing component is less than 40% by weight, the resulting lithographic printing plate precursor does not show sufficient oil-desensitivity when processed with an oil-desensitizing solution or dampening water, thus resulting in stain formation during printing.

The resin according to the present invention which contains at least one functional group of formula (I) is capable of forming a carboxyl group when hydrolyzed upon contact with an oil-desensitizing solution of dampening water used on printing. Therefore, when the resin is used as an outermost surface layer of a lithographic printing plate precursor, non-image areas can be rendered hydrophilic by the action of carboxyl groups formed in the resin. As a result, a marked contrast can be afforded between a lipophilic toner image area and a hydrophilic non-image area to prevent adhesion of a printing ink into the non-image area during printing.

For the purpose of improving the film strength of the surface layer to be rendered hydrophilic, the adhesion between the surface layer and the photosensitive layer, the electrophotographic characteristics, etc., the surface layer of the present invention may further contain other resins than those described above, crosslinking agents, plasticizers, and the like.

The crosslinking agent to be added includes generally employed organic peroxides, metallic soaps, organic silane compounds, polyurethane, and curing agents (e.g., epoxy resins). Specific examples of these crosslinking agents are described, e.g., in S, Yamashita and T. Kaneko (eds.), *Kakyozai Handbook,* Taiseisha (1981).

Further, developing characteristics with a toner, adhesiveness of a toner image, or water retention after oil-desensitization processing can be improved by mechanically matting the surface layer or incorporating a matting agent into the surface layer. The matting agent to be added include fillers, e.g., silicon oxide, zinc oxide, titanium oxide, zirconium oxide, glass beads, alumina, clay, etc., and polymer particles, e.g., polymethyl methacrylate, polystyrene, phenolic resins, etc.

What is important in construction of the surface layer is that the non-image area thereof should become sufficiently hydrophilic after oil-desensitization as mentioned above. The hydrophilic properties of the non-image area can be confirmed, for example by measuring a contact angle formed with water. While the contact angle with water of the surface layer before oil-desensitization is from about 60° to 120°, it is decreased to about 5° to 20° after oil-desensitization to attain high wettability by water. Hence, the resulting printing plate has formed thereon a lipophilic toner image area and a highly hydrophilic non-image area. In other words, sufficient hydrophilic properties of the surface layer would be assured by oil-desensitization so as to decrease a contact angle with water to 20° or less.

Thus, the lithographic printing plate precursor according to the present invention is particularly superior in hydrophilic properties on non-image areas as compared with those conventionally known.

The electrophotographic photosensitive layer, i.e., photoconductive layer, to be used in the present invention can be formed by using any of conventional photoconductive substances, either organic or inorganic.

The inorganic photoconductive substances to be used included zinc oxide, titanium oxide, zinc sulfide, selenium, selenium alloys, cadmium sulfide, cadmium selenide, silicone, etc. These inorganic substances can be used to form a photoconductive layer either alone (e.g., by deposition in vacuo, sputtering, or the like) or in combination with a binder resin.

The organic photoconductive substances which can be used include high-molecular compound, such as (1) the polyvinylcarbazole or derivatives thereof described in Japanese patent publication No. 10966/59, (2) the vinyl polymers described in Japanese patent publication Nos. 18674/68 and 19192/68, e.g., polyvinylpyrene, polyvinylanthracene, poly-2-vinyl-4-(4'-dimethylaminophenyl)-5-phenyl-oxazole, poly-3-vinyl-N-ethylcarbazole, etc., (3) the polymers described in Japanese patent publication No. 19193/68, e.g., polyacenaphthylene, polyindene, an acenaphthylene-styrene copolymer etc., (4) condensed resins, e.g., a pyrene-formaldehyde resin, a bromopyrene-formaldehyde resin, an ethylcarbazoleformaldehyde resin, etc., as described in Japanese patent publication No. 13940/81, (5) various type triphenylmethane polymers as described in Japanese patent application (OPI) Nos. 90833/81 and 161550/81; and low-molecular compounds, such as (6) triazole derivatives as described in U.S. Pat. No. 3,112,197, (7) oxadiazole derivatives as described in U.S. Pat. No. 3,189,447, (8) imidazole derivatives as described in Japanese patent publication No. 16096/62, (9) polyarylalkane derivatives as described in U.S. Pat.

Nos. 3,615,402, 3,820,989, and 3,542,544, Japanese patent publication Nos. 555/70 and 10983/76, and Japanese patent application (OPI) Nos. 93224/76, 17105/80, 4148/81, 108667/80, 156953/80, and 36656/81, (10) pyrazoline derivatives and pyrazolone derivatives as described in U.S. Pat. Nos. 3,180,729 and 4,278,746 and Japanese patent application (OPI) Nos. 88064/80, 88065/80, 105537/75, 51086/80, 80051/81, 88141/81, 45545/82, 112637/79, and 74546/80, (11) phenylenediamine derivatives as described in U.S. Pat. No. 3,615,404, Japanese patent publication No. 10105/76, Japanese patent application (OPI) Nos. 83435/79, 110836/79, and 119925/79, and Japanese patent publication Nos. 3712/71 and 28336/72, (12) arylamine derivatives as described in U.S. Pat. No. 3,567,450, Japanese patent publication No. 35702/74, West German Pat. (DAS) No. 1110518, U.S. Pat. Nos. 3,180,703, 3,240,597, 3,658,520, 4,232,103, 4,174,961, and 4,012,376, Japanese patent application (OPI) Nos. 144250/80, 119132/81, and 22437/81, and Japanese patent publication No. 27577/65, (13) the amino-substituted chalcone derivatives described in U.S. Pat. No. 3,526,501, (14) N,N-bicarbazyl derivatives as described in U.S. Pat. No. 3,542,546, (15) oxazole derivatives as described in U.S. Pat. No. 3,257,203, (16) styrylanthracene derivatives as described in Japanese patent application (OPI) No. 46234/81, (17) fluorenone derivatives as described in Japanese patent application (OPI) No. 110837/79, (18) hydrazone derivatives as described in U.S. Pat. Nos. 3,717,462 and 4,150,987 Japanese patent application (OPI) Nos. 52063/80, 52064/80, 46760/80, 85495/80, 11350/82, and 148749/82, and the like.

These photoconductive substances can be used either alone or in combination of two or more thereof.

Among the above-enumerated photoconductive substances, preferred are poly-N-vinylcarbazole; triarylamines, e.g., tri-p-tolylamine, triphenylamine, etc.; polyarylmethanes, e.g., 4,4'-bis(diethylamine)-2,2'-dimethyltriphenylmethane, etc.; and unsaturated heterocyclic ring-containing compounds exemplified by pyrazoline derivatives, e.g., 3-(4-dimethylaminophenyl)-1,5-diphenyl-2-pyrazoline, etc.

Binders to be combined with the photoconductive substance are conventional. Typical examples of the known binders are vinyl chloride-vinyl acetate copolymers, styrene-butadiene copolymers, styrene-butyl methacrylate copolymers, polymethacrylate, polyacrylate, polyvinyl acetate, polyvinyl butyral, alkyd resins, silicone resins, epoxy resins, epoxy ester resins, polyester resins, etc. The photoconductive substances may also be combined with aqueous acrylic emulsions or acrylic ester emulsions.

Specific examples of polymeric compounds which are useful as binder are given in *Research Disclosure,* Vol. 109, 61–67, "Electrophotographic Elements, Materials, and Methods".

The amount of the binder to be used in the photoconductive layer is generally subject to variation. The typical amount of the binder ranges from about 10 to about 90% by weight based on the total weight of the photoconductive substance and the binder.

If desired, the photoconductive layer may further contain known spectral sensitizers, such as xanthene dyes, triphenylmethane dye, azine dyes, phthalocyanine dyes (metallized), polymethane dyes, etc. Specific examples of these spectral sensitizers are described in H. Miyamoto and H. Takei (eds.), *Imaging,* No. 8, 2, "Kiroku Zairyo to Kankose Jushi" (1973), C. J. Young, *R.C.A. Review,* No. 15, 649 (1954), K. Kiyoda, *Dentki Tsushin Gakkai Ronbunshi,* J-63C, No. 2, 97 (1980), Y. Harazaki, *Kogyokagaku Zasshi,* 66, 78 and 188 (1963), T. Tani, *Nippon Shashin Gakkaishi,* No. 35, 208 (1972), *Research Disclosure,* RD No. 216, 117–118 (1982), and *Sogogijutsu Shiryoshu "Saikin no Kodendo Zairyo to Kantotai no kaihatsu Jitsuyoka",* Nihon Kagaku Joho (1986, etc.

The photoconductive layer may have a single-layer structure or a multi-layer structure. The multi-layer structure includes a separate function type photoconductive layer in which a charge generating layer comprising a deposited photoconductive substance or an organic pigment, e.g., phthalocyanine pigments and azo pigments, and, if necessary, a binder resin and a charge transport layer comprising the above-described high-molecular or low-molecular compound and a binder resin are laminated.

The photoconductive layer can be provided on any known support. In general, a support for an electrophotographic photosensitive layer is preferably electrically conductive. Any of conventionally employed conductive supports may be utilized in this invention. Examples of usable conductive supports include a base, e.g., a metal sheet, paper, a plastic sheet, etc., having been rendered electrically conductive by, for example, impregnating with a low resistant substance; a base with the back side thereof (i.e., opposite to the photosensitive layer side) being rendered conductive and having further coated thereon at least one layer for the purpose of prevention of curling, etc.; the aforesaid bases having provided thereon a water-resistant adhesive layer; the aforesaid bases having provided thereon at least one precoat layer; paper laminated with a plastic film on which aluminum, etc. is deposited; and the like.

Specific examples of conductive supports and materials for imparting conductivity which can be used in the present invention are described in S. Sakamoto, *Denshishashin,* Vol. 14, No. 1, 2–11 (1975), H. Moriga, *Nyumon Tokuhsushi no Kagaku,* Kobunshi Kankokai (1975), M. F. Hoover, *J. Macromol. Sci. Chem.,* A-4(6), 1327–1417 (1970), etc.

A photoconductive composition is coated on an appropriate support to a widely variable wet thickness, usually ranging from about 10 to about 300 μm, and preferably from about 50 to about 150 μm. Wet thickness out of the above-recited range also achieve satisfactory results. The dry thickness of the photoconductive layer ranges from about 1 to about 50 μm.

The surface layer capable of being rendered hydrophilic according to the present invention has a thickness of 10 μm or less, and preferably from 0.1 to 5 μm particularly for use in Carlson's processing. Thickness of the surface layer more than 10 μm would result in disadvantages, such as reduced sensitivity and increased residual potential of the resulting electrophotographic photoreceptor.

The lithographic printing plate precursor according to the present invention can be generally produced as follows. An electrophotographic photosensitive layer (photoconductive layer) is first formed on a conductive support in a usual manner. A coating composition prepared by dissolving or dispersing the resin of the invention and, if desired, various additives as described above in a volatile hydrocarbon solvent having a boiling point of 200° C. or lower is then coated on the photoconductive layer, followed by drying. The hydrocarbon solvent to be used preferably includes halogenated hydrocarbons, e.g., dichloroethane, dichloropropane, trichloroethane, etc. In addition, various solvents commonly employed for coating compositions, such as aromatic hydrocarbons, e.g., chlorobenzene, toluene, xylene, benzene, etc.; ketones, e.g., acetone, 2-butanone, etc.; ethers, e.g., tetrahydrofuran, etc.; methylene chloride; and mixtures thereof, can also be used.

The thus obtained printing plate precursor is subjected to a conventional electrophotographic processing in order to form a toner image thereon. The precursor is then processed with an oil-desensitizing solution, such as an acidic or alkaline aqueous solution, an aqueous solution having dissolved therein a reducing agent, and the like, to thereby render the non-image areas hydrophilic to produce a lithographic printing plate.

In addition to the above-referred conventional electrophotographic processing, toner image formation can be carried out by other various techniques, such as (1) a method comprising forming an electrostatic latent image on another electrophotographic photoreceptor, transferring the latent image on the photoreceptor of the present invention, and developing the electrostatic latent image with a toner, (2) a method comprising applying electrical signals to a multielectrode to form an electrostatic latent image corresponding to the electrical signals and developing the latent image with a toner, and (3) a method comprising forming an electrostatic latent image on an electrophotographic photoreceptor screen having a number of fine openings as described in Japanese Patent Publication Nos. 30320/70 and 5063/73 and Japanese Patent Application (OPI) No. 341/76, effecting a corona discharge through the electrostatic latent image to modulate the ionic stream of corona to thereby form an electrostatic latent image, and developing the latent image with a toner. The present invention is applicable to any of these techniques by providing the surface layer capable of being rendered hydrophilic directly on a conductive support.

Thus, use of the surface layer capable of being rendered hydrophilic according to the present invention makes it possible to produce a high quality lithographic printing plate precursor from any of conventionally known electrophotographic photoreceptors.

In the surface layer of the present invention, high hydrophilic properties attained by oil-desensitization processing are well compatible with water resistance. Moreover, the surface layer exhibits excellent adhesion to both a base and a toner image and, therefore, the resulting lithographic printing plate precursor has considerable freedom from background stain formation and high printing durability.

Since the printing plate precursor of the invention keeps substantially the same level of sensitivity inherent to the electrophotographic photoreceptor used, it shows greatly improved sensitivity over the conventional electrophotographic printing plate precursors. A photoconductive layer in the conventional printing plate precursors should satisfy both photoconductivity and capability of being rendered hydrophilic, so that it has been limited to a narrow range of materials (e.g., zinc oside). To make a contrast, in the present invention, since these functions are separately performed by a photoconductive layer and a layer to be rendered hydrophilic, the photoconductive substance for constructing the photoconductive layer can be selected from a wide range. Therefore, it would be possible, for example, to effect recording by an $H_2$–$N_2$ laser of a semi-conductor laser that has hitherto been impossible, by selecting a material having high sensitivity to the longer wavelength region.

In addition, since the processing of the non-image areas for rendering hydrophilic can be achieved simply by dipping the printing plate precursor in a processing solution for several seconds, plate making can be carried out in a simple and small-sized apparatus.

The present invention is now illustrated in greater detail by way of example, but it should be understood that the present invention is not deemed to be limited thereto.

EXAMPLE 1

Five grams of 4,4'-bis(diethylamino)-2,2'-dimethyltriphenylmethane as organic photoconductive substance, 5 g of polycarbonate of bisphenol A ("Lexan 121" produced by G.E.), 40 mg of a spectral sensitizing dye (A) of the formula shown below, and 0.2 g of an anilide compound (B) of the formula shown below as chemical sensitizer were dissolved in 30 ml of methylene chloride and 30 ml of ethylene chloride to prepare a photosensitive composition.

Spectral Sensitizing Dye (A)

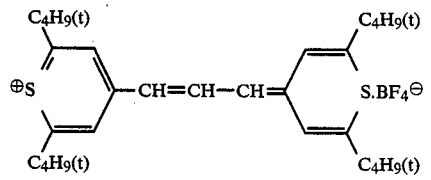

Anilide Compound (B)

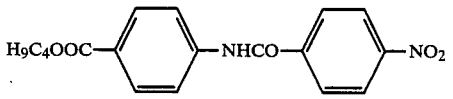

The photosensitive compositiion was coated on a transparent conductive support (a 100 μm thick polyethylene terephthalate base having deposited thereon indium oxide; surface resistivity: $10^3$ Ω) by means of a wire round rod to form a photosensitive layer having a thickness of about 4 μm.

A mixed solution consisting of 50 g of n-butyl methacrylate, 50 g of 2,2,2-trifluoroethyl methacrylate, and 200 g of toluene was heated to 75° C. under a nitrogen stream, and 1.5 g of azobisisobutyronitrile (AIBN) was added thereto, followed by allowing to react for 9 hours. The resulting copolymer had a weight average molecular weight of 39,000.

A 5% by weight solution of the resulting copolymer in toluene was coated on the above prepared photosensitive layer with a doctor blade to form a surface layer having a thickness of about 2 μm.

The resulting photosensitive material was subjected to oil-desensitization by passing once through an etching processor using an oil-desensitizing solution ("ELP-EX" produced by Fuji Photo Film Co., Ltd.). In order to evaluate the hydrophilic properties of the surface layer, a drop of 2 μl of the distilled water was placed on the surface layer, and a contact angle formed with the water was measured with a goniometer. The contact angles before and after the oil-desensitization were found to be 85° and 16°, respectively, clearly demonstrating that the surface layer was rendered highly hydrophilic by the oil-desensitization processing.

The above-prepared lithographic printing plate precursor was processed by an automatic printing plate making machine ("ELP 404V" manufactured by Fuji Photo Film Co., Ltd.) using a negatively chargeable liquid developer to form a toner image thereon. The precursor was then subjected to oil-desensitization under the same conditions as described above. The resulting printing plate (offset master plate) was mounted on an offset printing machine ("Hamada Star 800SX" manufactured by Hamada Star K.K.), and printing on fine paper was carried out.

The number of prints that could be obtained with no problem of image quality and background stain formation on the non-image areas was 10,000.

EXAMPLE 2

A mixture consisting of 5 g of a bisazo pigment of formula shown below, 95 g of tetrahydrofuran, and 30 g of a 5% by weight tetrahydrofuran solution of a polyvinyl butyral resin ("Denka Butyral #4000.1" produced by Electro Chemical Ind. Co., Ltd.) was thoroughly ground in a ball mill. The mixture was removed from the ball mill, and 520 g of tetrahydrofuran was added thereto. The resulting dispersion was coated on the same transparent conductive support as used in Example 1 with a wire round rod to form a charge generating layer having a thickness of about 0.7 μm.

Bisazo Pigment

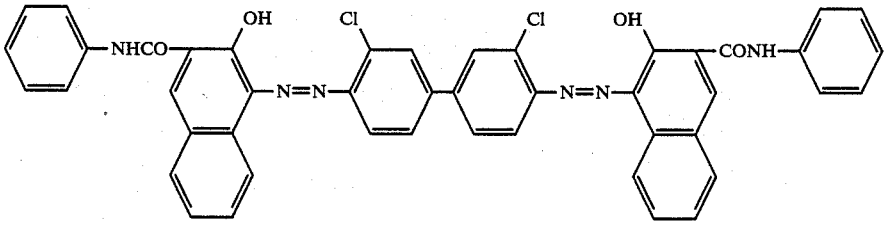

A mixed solution consisting of 20 g of a hydrazone compound of formula shown below, 20 g of a polycarbonate resin (Lexan 121), and 160 g of tetrahydrofuran was coated on the charge generating layer with a wire round rod to form a charge transport layer having a thickness of about 18 μm. There was obtained an electrophotographic photoreceptor. having a double-layered photosensitive layer.

Hydrazone Compound

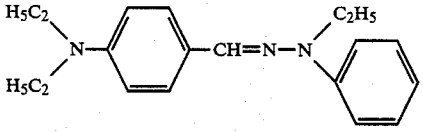

Separately, a mixed solution consisting of 40 g of ethyl methacrylate, 60 g of t-butyldimethylsilyl methacrylate, and 200 g of toluene was heated to 75° C. under a nitrogen stream, and 1.5 g of AIBN was added thereto, followed by allowing to react for 8 hours. The resulting copolymer had a weight average molecular weight of 38,000.

A 5% by weight solution of the resulting copolymer in toluene was coated on the above-prepared photosensitive layer with a doctor blade to form a surface layer having a thickness of about 2 μm.

The thus obtained photosensitive material was negatively charged to −6 KV by means of a paper analyzer ("SP428" manufactured by Kawaguchi Denki K.K.). As a result, the photosensitive material was found to have an initial potential (Vo) of −580 V, a retention of dark charge (DRR) of 88%, and a half decay exposure ($E_{\frac{1}{2}}$) of 53.1 erg/cm$^2$.

Further, the photosensitive material was processed by an automatic plate making machine "ELP 404V" using a toner ("ELP-T" manufactured by Fuji Film Co., Ltd.) in the same manner as in Example 1. The resulting master plate for offset printing had a clear image having a density of 1.0 or more. After etching processing, the master plate was used for printing. The print obtaining 10,000 prints had a clear image and no fog on the non-image area.

EXAMPLE 3

A mixed solution consisting of 27 g of ethyl methacrylate, 70 g of a monomer of formula shown below, 3 g of 2-hydroxyethyl methacrylate, and 200 g of toluene was subjected to polymerization reaction under the same conditions as in Example 2 to obtain a copolymer having a weight average molecular weight of 38,000.

Monomer

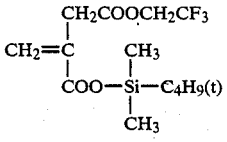

To a 5% by weight toluene solution of the copolymer was added 0.15 g of toluene-2,4-diisocyanate, and the resulting solution was coated on the same double-layered photosensitive layer as prepared in Example 2 with a doctor blade, dried at 110° C. for 1 minute, and then heat-treated at 150° C. for 30 minutes to form a surface layer having a thickness of about 1.8 μm.

The resulting lithographic printing plate precursor was determined for electrostatic characteristics by the use of a paper analyzer under the same conditions as in Example 2 and was found to have Vo of −600 V, DRR of 87% , and $E_{\frac{1}{2}}$ of 55.6 erg/cm$^2$.

The printing plate precursor was processed in an automatic plate making machine, ELP-404V in the same manner as in Example 2. The resulting master plate for offset printing had a clear image having a density of 1.0 or more. After etching processing, the master plate was used for printing. As a result, the print after obtaining 10,000 prints had a clear image with no fog on the non-image area.

EXAMPLES 4 TO 6

Each of copolymers (D) to (F) shown in Table 1 below was prepared under the same polymerization conditions as in Example 1.

TABLE 1

| Example No. | Copolymer | | Weight Average Molecular Weight |
|---|---|---|---|
| 4 | (D) | 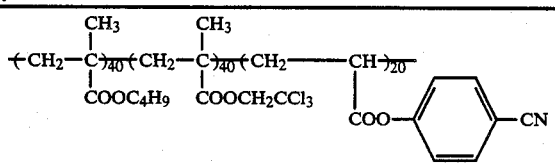 | 37,000 |
| 5 | (E) | 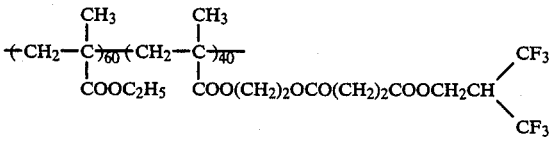 | 38,000 |
| 6 | (F) | 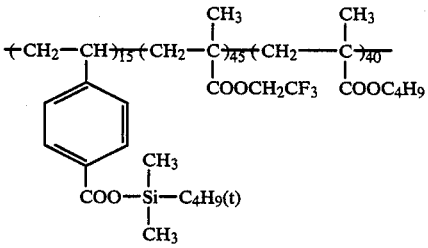 | 35,000 |

A lithographic printing plate precursor was produced in the same manner as in Example 1, except for replacing the copolymer as used in Example 1 for the surface layer with the copolymer of Table 1. The electrostatic characteristics of the printing plate precursor were determined with a paper analyzer in the same manner as in Example 2. The printing plate precursor was then processed by an automatic plate making machine (ELP-404V) in the same manner as in Example 2, and the resulting master plate was evaluated in the same manner as in Example 2. The results obtained are shown in Table 2.

TABLE 2

| Example No. | Copolymer Used | Vo (V) | DRR (%) | $E_{\frac{1}{2}}$ (erg/cm$^2$) | Image on Plate: Density | Image on Plate: Quality | Printing Durability |
|---|---|---|---|---|---|---|---|
| 4 | (D) | 590 | 85 | 56.2 | 1.0 or more | clear | 10,000 prints or more |
| 5 | (E) | 580 | 86 | 54.1 | " | " | " |
| 6 | (F) | 590 | 84 | 55.0 | " | " | " |

The results of Table 2 were equal to those of Examples 1 and 2.

EXAMPLE 7

A mixed solution consisting of 20 g of ethyl methacrylate, 80 g of Compound (30) and 200 g of tetrahydrofuran was heated at 70° C. under a nitrogen stream, and 10 g of AIBN was added thereto, followed by allowing to react for 8 hours. The resulting copolymer had a weight average molecular weight of 65,000.

A 5% by weight tetrahydrofuran solution of the copolymer was coated on the same photosensitive layer as prepared in Example 1 with a doctor blade to form a surface layer having a thickness of about 2 μm. The resulting lithographic printing plate precursor was subjected to oil-desensitization by passing once through an etching processor using an oil-desensitizing solution "ELP-EX".

The contact angles with water of the surface layer before and after the oil-desensitization were 86° and 18°, respectively, as measured in the same manner as in Example 1, clearly demonstrating that the surface layer was rendered satisfactorily hydrophilic by the oil-desensitization.

A master plate for offset printing was produced from the thus obtained printing plate precursor in the same manner as in Example 1. When printing was carried out using the master plate in the same manner as in Example 1, substantially the same results as in Example 1 were obtained.

EXAMPLE 8

A mixed solution consisting of 25 g of benzyl methacrylate, 75 g of Compound (31), and 200 g of methyl acetate was heated at 75° C. under a nitrogen stream, and 1.0 g of AIBN was added thereto, followed by allowing to react for 8 hours. The resulting copolymer had a weight average molecular weight of 54,000.

A 5% by weight solution of the resulting copolymer in ethyl acetate was coated on the same double-layered photosensitive layer as prepared in Example 2 with a doctor blade plate to form a surface layer having a thickness of about 2 μm.

When the resulting printing plate precursor was negatively charged to −6 KV with a paper analyzer, Vo, DRR, and $E_{\frac{1}{2}}$ were found to be −555 V, 85%, and 88 erg/cm$^2$, respectively.

A master plate for offset printing was produced from the printing plate precursor in the same manner as in Example 2. The master plate had a clear image having a density of 1.0 or more. After etching processing, printing was carried out using the master plate. As a result, the print after producing 10,000 prints had a clear image with no fog on the non-image area.

EXAMPLE 9

A mixed solution consisting of 10 g of benzyl methacrylate, 10 g of 2-hydroxyethyl methacrylate, 80 g of Compound (38), and 250 g of toluene was heated at 80° C. under a nitrogen stream, and 1.5 g of AIBN was added thereto, followed by reacting for 8 hours. The resulting copolymer had a weight average molecular weight of 33,000.

To 20 g of a 5% by weight toluene solution of the copolymer was added 0.15 g of toluene-2,4-diisocyanate, and the solution was coated on the same double-layered photosensitive layer as prepared in Example 2 with a doctor blade, dried at 110° C. for 1 minute, and heat-treated at 150° C. for 30 minutes to form a surface layer having a thickness of about 1.8 μm. The resulting lithographic printing plate precursor was evaluated for electrostatic characteristics with a paper analyzer under the same conditions as in Example 2 and was found to have Vo of −530 V, DRR of 84%, and $E_{\frac{1}{2}}$ of 87 erg/cm$^2$.

The printing plate precursor was processed in an automatic plate making machine, ELP-404 V, in the same manner as in Example 2. The resulting master plate for offset printing had a clear image having a density of 1.0 or more. After etching processing, printing was carried out using the same master plate. As a result, the print after obtaining 10,000 prints had a clear image with no fog on the non-image area.

EXAMPLE 10

A mixed solution consisting of 20 g of butyl methacrylate, 15 g of ethyl methacrylate, 65 g of Compound (46), 0.1 g of itaconic acid, and 300 g of toluene was heated at 75° C. under a nitrogen stream, and 1.0 g pf AIBN was added thereto, followed by allowing to react for 8 hours. The resulting copolymer had a weight average molecular weight of 56,000.

A surface layer having a thickness of about 1.8 μm was formed on a photosensitive layer in the same manner as in Example 9, but replacing the copolymer as used in Example 9 with the above-prepared copolymer. The resulting lithographic printing plate precursor was found to have Vo of −550 V, DRR of 83%, and $E_{\frac{1}{2}}$ of 88 erg/cm$^2$ as measured in the same manner as in Example 2.

The printing plate precursor was processed in an automatic plate making machine, ELP-440 V, to obtain a master plate for offset printing. The master plate had a clear image having a density of 1.0 or more. After etching processing, printing was carried out using the master plate. As a result, the print after obtaining 10,000 prints had a clear image with no fog on the non-image areas.

EXAMPLES 11 TO 17

Each of the copolymers shown in Table 3 below was prepared under the same polymerization conditions as in Example 7.

TABLE 3

| Example No. | Copolymer | Weight Average Molecular Weight |
|---|---|---|
| 11 | (E) 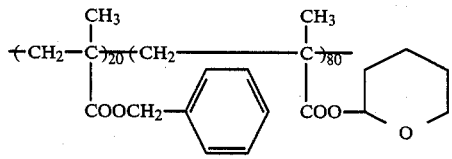 | 30000 |
| 12 | (F) 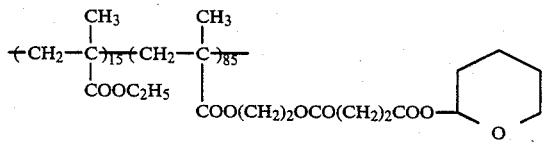 | 35000 |
| 13 | (G) 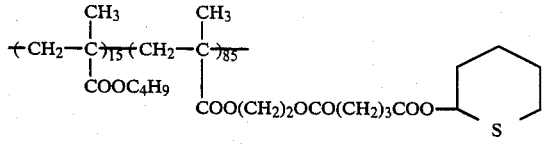 | 40000 |
| 14 | (H) 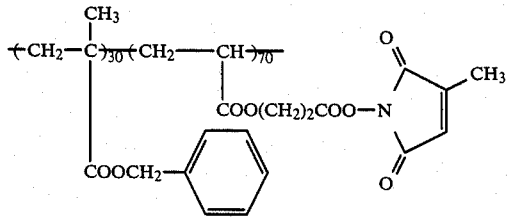 | 38000 |

TABLE 3-continued

| Example No. | Copolymer | | Weight Average Molecular Weight |
|---|---|---|---|
| 15 | (I) | 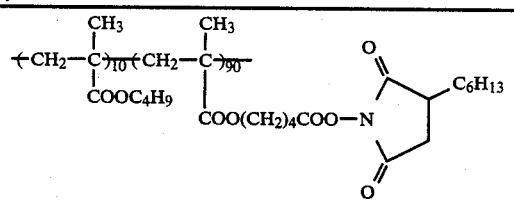 | 35000 |
| 16 | (J) | 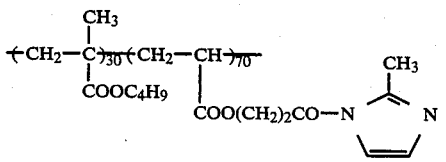 | 36000 |
| 17 | (K) | 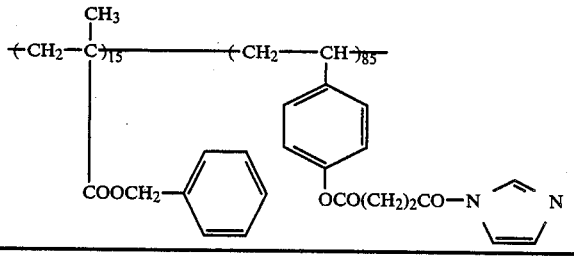 | 32000 |

A lithographic printing plate precursor was produced in the same manner as in Example 1, except for replacing the resin as used in Example 1 for the surface layer with the copolymer of Table 3.

Electrostatic characteristics of the printing plate precursor were determined in the same manner as in Example 2. The precursor was then processed in an automatic plate making machine, ELP-404 V, and printing was carried out using the resulting master plate for offset printing. The results obtained are shown in Table 4 below.

TABLE 4

| Example No. | Copolymer Used | Vo (V) | DRR (%) | $E_{\frac{1}{2}}$ (erg/cm$^2$) | Image on Plate: Density | Image on Plate: Quality | Printing Durability |
|---|---|---|---|---|---|---|---|
| 11 | (E) | 560 | 83 | 87 | 1.0 or more | clear | 10,000 prints or more |
| 12 | (F) | 565 | 83 | 85 | " | " | " |
| 13 | (G) | 570 | 82 | 88 | " | " | " |
| 14 | (H) | 530 | 84 | 87 | " | " | " |
| 15 | (I) | 545 | 86 | 84 | " | " | " |
| 16 | (J) | 550 | 85 | 89 | " | " | " |
| 17 | (K) | 555 | 85 | 90 | " | " | " |

As can be seen from Table 4, the lithographic printing plate precursors of Examples 11 to 17 and master plates obtained therefrom had performance properties equal as those of Example 1.

While the invention has been described in detail and with reference to specific embodiments thereof, it will be apparent to one skilled in the art that various changes and modifications can be made therein without departing from the spirit and scope thereof.

What is claimed is:

1. An electrophotographic lithographic printing plate precursor comprising a conductive support having provided thereon at least one photoconductive layer and further provided thereon an outermost surface layer, in which said surface layer contains at least one resin having at least one functional group capable of forming a carboxyl group upon decomposition which is represented by formula (I):

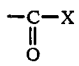

(I)

wherein X represents

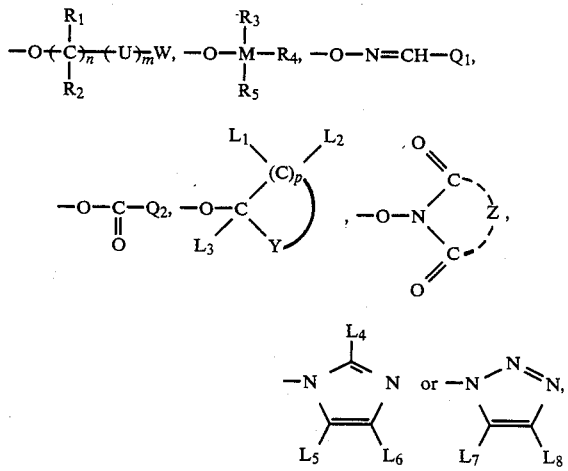

wherein $R_1$ and $R_2$, which may be the same or different, each represents a hydrogen atom or an aliphatic group; U represents an aromatic ring; W represents a hydrogen atom, a halogen atom, a trihalomethyl group, an alkyl group, —CN, —$NO_2$, —$SO_2R_6$, —$COOR_7$ or —O—$R_8$, wherein $R_6$, $R_7$, and $R_8$ each represents a hydrocarbon group; n and m each represents 0, 1 or 2; $R_3$, $R_4$, and $R_5$, which may be the same or different, each represents a hydrocarbon group or —O—$R_9$, wherein $R_9$ represents a hydrocarbon group; M represents Si, Sn or Ti; $Q_1$ and $Q_2$ each represents a hydrocarbon group; Y represents an oxygen atom or a sulfur atom; $L_1$, $L_2$, and $L_3$, which may be the same or different, each represents a hydrogen atom or an aliphatic group; p represents 3 or 4; Z represents an organic residue forming a cyclic imide group; and $L_4$, $L_5$, $L_6$, $L_7$, and $L_8$, which may be the same or different, each represents a hydrogen atom or an aliphatic group; or $L_5$ and $L_6$, or $L_7$ and $L_8$ are connected to each other, respectively, to form a condensed ring.

2. An electrophotographic lithographic printing plate precursor as claimed in claim 1, wherein X represents

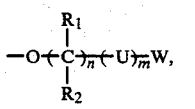

wherein $R_1$ and $R_2$, which may be the same or different, each represents a hydrogen atom or a substituted or unsubstituted straight or branched chain alkyl group having from 1 to 6 carbon atoms; U represents a substituted or unsubstituted phenyl or naphthyl group; W represents a hydrogen atom, a halogen atom, a trihalomethyl group, a substituted or unsubstituted straight or branched chain alkyl group having from 1 to 6 carbon atoms, —CN, —$NO_2$, —$SO_2R_6$, wherein $R_6$ represents an aliphatic group, an aralkyl group, or an aromatic group, —$COOR_7$, wherein $R_7$ has the same meaning as $R_6$, or —O—$R_8$, wherein $R_8$ has the same meaning as $R_6$; and n and m each represents 0, 1 or 2.

3. An electrophotographic lithographic printing plate precursor as claimed in claim 1, wherein X represents

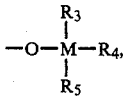

wherein $R_3$, $R_4$, and $R_5$, which may be the same or different, each represents a substituted or unsubstituted aliphatic group having from 1 to 6 carbon atoms, a substituted or unsubstituted aromatic group having from 6 to 14 carbon atoms, or —O—$R_9$, wherein $R_9$ represents a substituted or unsubstituted alkyl group having from 1 to 6 carbon atoms, a substituted or unsubstituted alkenyl group having from 2 to 6 carbon atoms, a substituted or unsubstituted aralkyl group having from 7 to 12 carbon atoms, a substituted or unsubstituted alicyclic group having from 5 to 10 carbon atoms or a substituted or unsubstituted aryl group having from 6 to 10 carbon atoms; and M represents Si, Ti or Sn.

4. An electrophotographic lithographic printing plate precursor as claimed in claim 3, wherein M represents Si.

5. An electrophotographic lithographic printing plate precursor as claimed in claim 1, wherein X represents —O—N=CH—$Q_1$ or

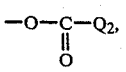

wherein $Q_1$ and $Q_2$ each represents a substituted or unsubstituted aliphatic group having from 1 to 6 carbon atoms or a substituted or unsubstituted aryl group having from 6 to 12 carbon atoms.

6. An electrophotographic lithographic printing plate precursor as claimed in claim 1, wherein X represents

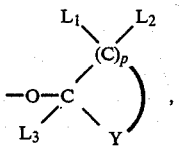

wherein Y represents an oxygen atom or a sulfur atom; $L_1$, $L_2$, and $L_3$, which may be the same or different, each represents a hydrogen atom, a substituted or unsubstituted straight or branched chain alkyl group having from 1 to 18 carbon atoms, a substituted or unsubstituted alicyclic group, a substituted or unsubstituted aralkyl group having from 7 to 12 carbon atoms, a substituted or unsubstituted aromatic group, or —O—L′, wherein L′ represents a hydrocarbon group; and p represents an integer 3 or 4.

7. An electrophotographic lithographic printing plate precursor as claimed in claim 1, wherein X represents

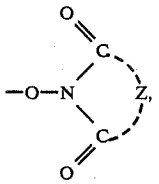

wherein X represents an organic residue represented by formula (II) or (III):

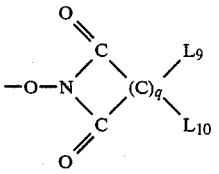

(II)

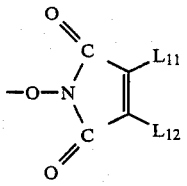

(III)

wherein $L_9$ and $L_{10}$, which may be the same or different, each represents a hydrogen atom, a halogen atom, a substituted or unsubstituted alkyl group having from 1 to 18 carbon atoms, a substituted or unsubstituted aralkyl group having from 7 to 12 carbon atoms, and a substituted or unsubstituted alkenyl group having from 3 to 18 carbon atoms, —$SL_{13}$, wherein $L_{13}$ represents a group selected from the alkyl, aralkyl and alkenyl groups for $L_9$ or $L_{10}$, a substituted or unsubstituted aryl group, or —$NHL_{14}$, wherein $L_{14}$ has the same meaning as $L_{13}$; or $L_9$ and $L_{10}$ together may form a ring; q represents 2 or 3; and $L_{11}$ and $L_{12}$, which may be the same or different, each has the same meaning as $L_9$ or $L_{10}$; or $L_{11}$ and $L_{12}$ together may form an aromatic ring.

8. An electrophotographic lithographic printing plate precursor as claimed in claim 1, wherein X represents

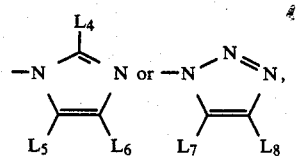

wherein $L_4$, $L_5$, $L_6$, $L_7$, and $L_8$ each represents a hydrogen atom, a substituted or unsubstituted straight or branched chain alkyl group having from 1 to 18 carbon atoms, a substituted or unsubstituted alicyclic group, a substituted or unsubstituted aralkyl group having from 7 to 12 carbon atoms, a substituted or unsubstituted aromatic group, or —O—L', wherein L' represents a hydrocarbon group, or a pair of $L_5$ and $L_6$ or a pair of $L_7$ and $L_8$ connected to each other to form a condensed ring.

9. An electrophotographic lithographic printing plate precursor as claimed in claim 1, wherein said resin is a homopolymer or copolymer comprising at least 40% by weight of a monomer unit derived from a compound represented by formula (IV):

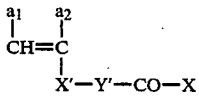

(IV)

wherein X is as defined above; X' represents

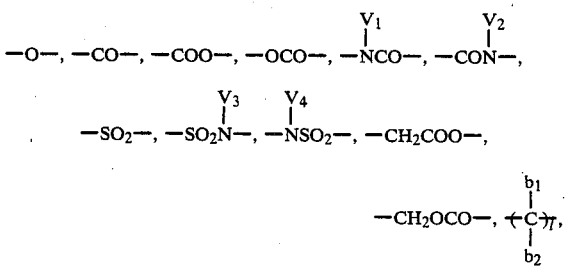

an aromatic group, or a heterocyclic group, wherein $V_1$, $V_2$, $V_3$, and $V_4$ each represents a hydrogen atom, a hydrocarbon residue, or the group —Y'—CO—X in formula (IV); $b_1$ and $b_2$, which may be the same or different, each represents a hydrogen atom, a hydrocarbon group, or the group —Y'—CO—X in formula (IV); and l represents 0 or an integer of from 1 to 18; Y' represents a carbon—carbon bond for linking X' and —CO—X which may contain a hetero atom; and $a_1$ and $a_2$, which may be the same or different, each represents a hydrogen atom, a hydrocarbon group, a carboxyl group, or —COO—T, wherein T represents an alkyl, alkenyl, aralkyl, alicyclic, or aromatic group having from 1 to 18 carbon atoms which may be substituted with a group containing —CO—X.

10. An electrophotographic lithographic printing plate precursor as claimed in claim 9, wherein said resin is a copolymer comprising from 40 to 80% by weight of a monomer unit derived from the compound represented by formula (IV).

11. An electrophotographic lithographic printing plate precursor as claimed in claim 1, wherein said surface layer has a thickness of 10 μm or less.

12. An electrophotographic lithographic printing plate precursor as claimed in claim 1, wherein the resin containing the functional group of formula (I) is a homopolymer or copolymer comprising from 40 to 100% by weight of a monomer unit containing the functional group.

13. An electrophotographic lithographic printing plate precursor as claimed in claim 1, wherein the said resin has a molecular weight of from $1\times10^3$ to $1\times10^6$.

14. An electrophotographic lithographic printing plate precursor as claimed in claim 1, wherein the photoconductive layer contains a binder in an amount of from about 10 to 90% by weight based upon the total weight of the photoconductive substance and the binder.

15. An electrophotographic lithographic printing plate precursor as claimed in claim 1, wherein the said photoconductive composition is coated on the said conductive support in an amount of from about 10 to about 300 μm.

16. An electrophotographic lithographic printing plate precursor as claimed in claim 1, wherein said surface layer contains said resin in an amount of at least 40% by weight based on the total resin present in the surface layer.

* * * * *